United States Patent [19]

Gerlach et al.

[11] 4,431,433

[45] Feb. 14, 1984

[54] SINGLE STAGE LIQUID MOTOR AND PUMP

[76] Inventors: Charles R. Gerlach, 639 W. Rhapsody, San Antonio, Tex. 78216; Rodney T. Heath, 4901 E. Main, Farmington, N. Mex. 87401

[21] Appl. No.: 417,903

[22] Filed: Sep. 14, 1982

[51] Int. Cl.[3] ..... B01D 53/26

[52] U.S. Cl. ..... 55/29; 55/208; 91/164; 91/313; 417/404

[58] Field of Search ..... 55/29–32, 55/208; 91/164, 224, 226, 313, 321, 342; 417/404

[56] References Cited

U.S. PATENT DOCUMENTS

| | | | |
|---|---|---|---|
| 2,781,864 | 2/1957 | Jahn et al. | 55/30 |
| 2,990,910 | 7/1961 | Kimmell | 55/32 |
| 3,093,122 | 6/1963 | Sachnik | 91/313 |
| 3,094,574 | 6/1963 | Glasgow et al. | 55/32 X |
| 3,105,748 | 10/1963 | Stahl | 55/32 |
| 3,288,448 | 11/1966 | Patterson et al. | 55/32 X |
| 3,331,188 | 7/1967 | Sinex | 55/31 |
| 3,541,763 | 11/1970 | Heath | 55/31 X |
| 4,286,929 | 9/1981 | Heath et al. | 417/404 |
| 4,342,572 | 8/1982 | Heath | 55/208 X |

*Primary Examiner*—Robert H. Spitzer
*Attorney, Agent, or Firm*—Klaas & Law

[57] ABSTRACT

A liquid motor is driven by pressurized wet glycol, received from an absorber of a natural gas dehydrating system, and utilizes the energy of the pressurized wet glycol to provide the primary source of energy for operating a pump for pumping of dry glycol from a reboiler to the absorber. A gas driven motor regulates the stroking rate of the glycol driven motor. The liquid motor and pump are provided by a single stage double acting piston in a cylinder with fluid intake and exhaust valving and passages to alternately fill and exhaust the motor side of the cylinder while the opposite pump side of the cylinder is simultaneously alternately filled and exhausted. A spool type valve rod, associated with the glycol driven motor, is operated by the gas driven motor to regulate the rate of reciprocation of the glycol driven motor and to provide a secondary source of energy therefor. Intake and exhaust of wet glycol to the motor side of the cylinder is controlled by gas applied to another spool type valve rod.

15 Claims, 7 Drawing Figures

SINGLE STAGE LIQUID MOTOR AND PUMP

BACKGROUND AND SUMMARY OF INVENTION

This invention relates to a fluid pumping system and, more particularly, to a fluid pumping system adapted for use with a natural gas dehydrating system of the type employed at a gas well head to remove water from a well stream composed of a mixture of gas, oil and water.

Examples of such gas dehydrating systems are disclosed in U.S. Pat. Nos. 3,094,574; 3,288,448; and 3,541,763; the disclosures of which are specifically incorporated herein by reference. In general, such systems comprise a separator means for receiving the gas-oil-water mixture from the well head and separating the oil and water liquids from "wet" (water vapor laden) gas; and a water absorber means, which employs a liquid dehydrating agent such as glycol, for removing the water vapor from the wet gas and producing "dry" gas suitable for commercial usage. The glycol is continuously supplied to the absorber means in a "dry" low water vapor pressure condition and is removed from the absorber means in a "wet" high water vapor pressure condition. The wet glycol is continuously removed from the absorber means and circulated through a reboiler means for removing the absorbed water from the glycol to provide a new supply of dry glycol. The glycol reboiler means usually comprises a still column associated with a gas burner for heating the wet glycol to produce hot dry glycol by removing the absorbed water by vaporization. The hot dry glycol passes through a heat exchanger, where the hot dry glycol is cooled and the incoming wet glycol is heated, to a dry glycol storage tank. A glycol passage means is provided to enable passage of wet glycol from the absorber means to the reboiler means and to pump dry glycol from the storage tank to the absorber means.

Prior to the inventions described in our copending U.S. patent application, Ser. No. 277,266, filed June 25, 1981 now U.S. Pat. No. 4,402,652 and our U.S. Pat. No. 4,286,929, the disclosure of which are hereby incorporated herein by reference, motors for glycol pumps of natural gas dehydrating systems were designed to be operated by the energy of natural gas available at the well head due to the relatively high pressures and temperatures thereof. In addition, some prior art pumps used the energy of the wet glycol to drive a single piston pump for the dry glycol as disclosed in U.S. Pat. No. 3,093,122 to Sachnik dated June 11, 1963. The Sachnik pumping unit uses a fluid driven power piston, and a pilot valve driven by the same fluid controls the rate of operation of the master slide valve, which distributes fluid to the piston pump.

One of the problems with such prior pump designs is that the pressure of the gas stream from natural gas wells is highly variable and gas operated pumps often require large amounts of energy. Furthermore, changes in gas pressures during day to day operation have often caused stalling of the pump and interruption of the entire dehydrating system. Since the dehydrating systems are continuously operated at the well site without continuous monitoring by operating personnel, reliable continuous operation of the pump is of critical importance.

Another important performance factor is that the pump be self-regulating to automatically adjust the pumping rate in accordance with available gas pressure and flow rates. In addition, it is highly desirable to use energy sources available at the well site for operation of the pump with maximum efficiency and minimum energy loss.

The present invention provides a new improved glycol pumping system which is operated by an available energy source other than the saleable dry natural gas at the well head; which may be operated at relatively low speeds and pressures without stalling; and which is automatically continuously operable under a wide range of operating conditions.

The pumping system comprises a glycol operated motor-pump section and a gas operated motor-controller section. The glycol motor-pump section comprises a cylinder and a piston reciprocably movable therein which provides a variable volume glycol motor chamber on one side of the piston and a variable volume glycol pump chamber on the opposite side of the piston. The motor chamber is alternately connected to high pressure wet glycol from the absorber and to the reboiler through wet glycol flow control valve means. High pressure wet glycol in the motor chamber drives the piston in one direction during a pumping stroke and is exhausted from the one chamber during a return stroke of the piston. Low pressure dry glycol is drawn into the pump chamber from the dry glycol tank piston during the return stroke and is forced from the pump chamber to the absorber during the piston pumping stroke through suitable check valve means. The gas motor-controller section comprises a cylinder and a piston reciprocably movable therein which provide a pair of variable volume gas chambers on opposite sides of the piston. The glycol motor piston and the gas motor piston are connected to opposite ends of a piston rod which extends between the glycol cylinder and the gas cylinder. Dry gas at relatively high pressure is alternately connected to and exhausted from the gas chambers on opposite sides of the gas piston through gas flow control valve means whereby gas pressure acts on the gas piston to assist movement of the glycol piston during the pumping stroke and to act as the primary motivating force during the return stroke of the glycol piston.

In the presently preferred embodiment, the gas flow control valve means is a reciprocable spool type valve operable between opposite gas intake and exhaust positions relative to the gas chambers by alternate application of gas to opposite ends of the spool type valve controlled by the position of the gas piston in the gas cylinder. In addition, the wet glycol flow control valve means is a reciprocable spool type valve operable between spaced opposite glycol intake and exhaust positions by alternate application and exhaust of gas at opposite ends thereof which is controlled by the gas flow control valve means. Thus intake and exhaust of wet glycol at the glycol motor chamber of the motor-pump section is synchronized with intake and exhaust of gas in the gas chambers of the motor-controller section.

In the illustrative and presently preferred embodiments of the invention, a gas operated piston and a glycol operated piston are concentrically mounted on opposite ends of a piston rod of substantially smaller diameter than the gas or glycol pistons. The gas and glycol pistons may or may not be of the same diameter, depending on the design requirements of a given application. The gas and glycol pistons move axially and are sealed within the bores of separate axially spaced gas and glycol cylinders, respectively. The gas and glycol cylinders are mounted on opposite ends of a centrally located seal plate through which the piston rod extends. A central fluid vent cavity is provided in the seal plate to receive any glycol or gas which may bypass seals mounted in the seal plate which normally prevent leakage of glycol and gas from the cylinders into the central vent cavity in the seal plate. Reciprocation of the gas piston is controlled by a four way gas operated shuttle valve of the spool type. Shifting of the gas spool valve is accomplished by a gas pilot system comprising a gas groove on the periphery of the gas piston which is alternately connected to shift ports at opposite ends of the gas cylinder and passages extending to opposite ends of the gas spool valve. Pump speed is generally controlled by a manual control valve mounted in the gas inlet line. Control of the wet glycol to and from the associated motor cylinder chamber is accomplished by a three-way spool type shuttle valve which is shifted by gas pressure signals from the gas shuttle valve which act through flexible diaphragms onto opposite end portions of glycol shuttle valve to thereby shift the glycol shuttle valve from the wet glycol intake position to the opposite wet glycol exhaust position.

BRIEF DESCRIPTION OF DRAWING

The present invention is illustrated in the accompanying drawing wherein.

DETAILED DESCRIPTION

In General

Figure 1:
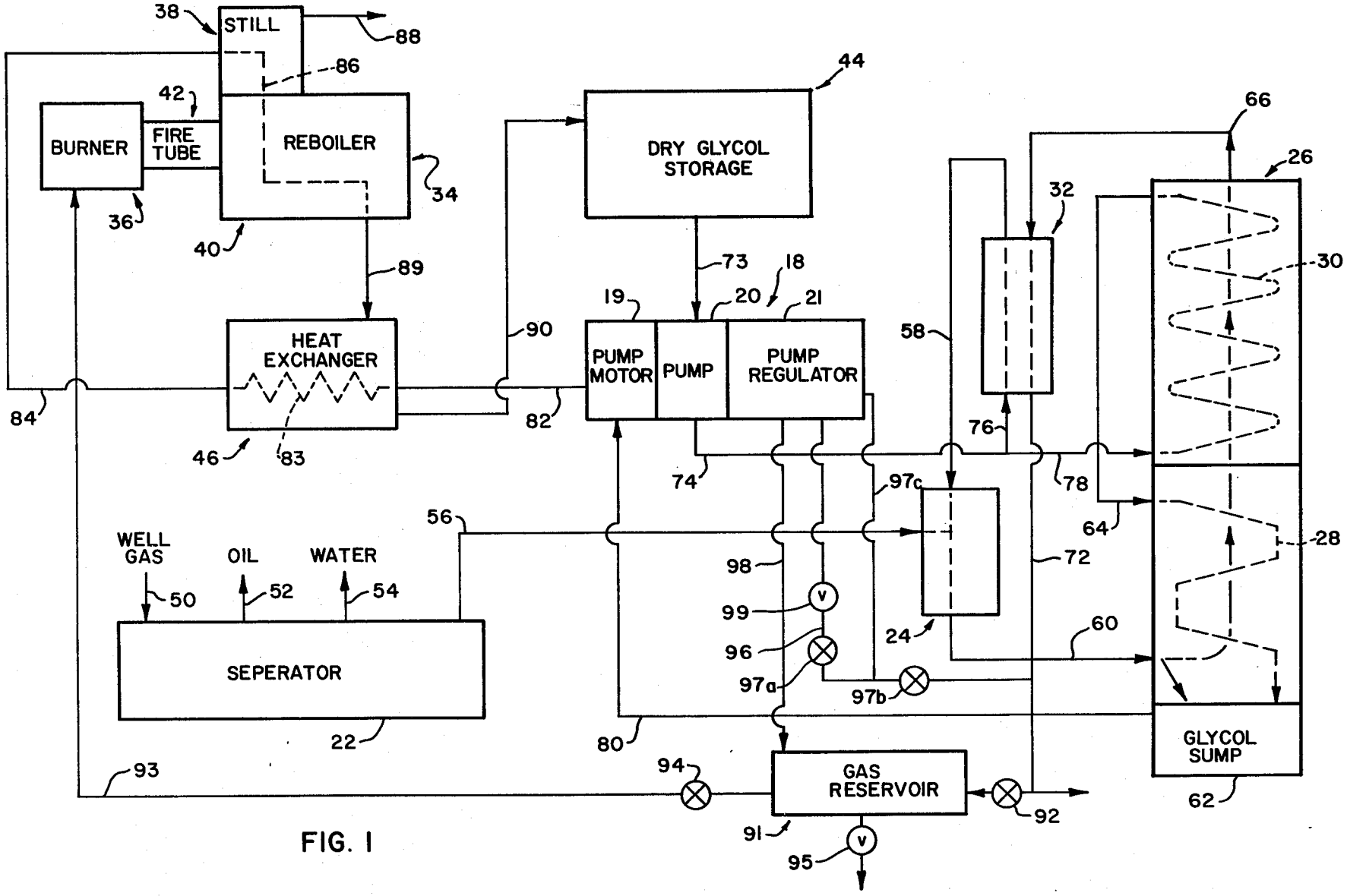
FIG. 1 is a schematic diagram of the pumping system in use in a natural gas dehydrating system.

Referring to FIG. 1, a pump means 18 of the present invention comprises combined motor pump sections 19, 20 and a motor-regulator section 21 which are shown in association with the major components of a three-phased dual-contact conventional natural gas dehydration system comprising: a gas-liquid separator means 22 for removing oil and water liquids from water vapor laden well gas; a packed glycol-gas contactor means 24 for first stage removal of water vapor from the well gas by contacting the well gas with dry glycol during cocurrent downward flow thereof; an absorber means 26 for second stage removal of water vapor from the well gas, including an internal tray stack means 28 for providing a downward gravity flow of dry glycol with upward counter flow of the well gas therethrough and an internal gas-glycol heat exchanger means 30 for cooling of dry glycol prior to entry of the dry glycol into the stack tray means 28; an external gas-glycol heat exchanger means 32 for cooling the dry glycol prior to entry into the glycol-gas contactor means; a glycol reboiler means 34 for removing water from the wet glycol, including a gas burner means 36 for heating the wet glycol, a still column means 38 for separating the water and the glycol by vaporizing the water, a tank means 40 for holding hot dry glycol, and a firetube means 42 in the tank means 40 for heating the hot dry glycol; a dry glycol storage tank means 44 for storing the dry glycol prior to return to the absorber means; and a glycol-glycol heat exchanger means 46 for cooling the hot dry glycol from the reboiler means before entry into the storage tank means while preheating the wet glycol from the absorber means before entry into the reboiler means.

In operation of the system of FIG. 1, well gas under pressure enters separator means 22 through an inlet line 50. The well gas is separated into liquid oil, water and wet gas which includes the natural gas and water vapor. Liquid oil and water are removed from the separator through outlet lines 52, 54. Wet gas under pressure is transmitted through a line 56 to the packed glycol-gas contactor means 24 whereat dry glycol from a line 58 is mixed with the wet gas. The dry glycol and wet gas flow downwardly through contactor means 24 wherein the dry glycol absorbs a portion of the water vapor. Wet glycol and partially wet gas are removed from the contactor means through a line 60 which is connected to the lower end of absorber means 26 between a wet glycol sump 62 at the bottom of the absorber means and stacked tray means 28. Wet glycol from line 60 flows downwardly into the glycol sump 62. Wet gas flows upwardly in the absorber through the stacked tray means 28 which provides a downward flow path for dry glycol received from line 64 to the glycol sump. In this manner, additional amounts of water vapor are removed from the gas which then flows upwardly through heat exchanger means 30 to an outlet line 66 and then downwardly through heat exchanger means 32 to a pipeline 72 which contains dry saleable natural gas at relative high pressures of, for example, 50 psi to 1000 psi. The dry glycol is delivered from storage means 44 to the packed gas-glycol contactor means 24 and the absorber means 26 under pressure through a pump inlet line 73, pump 20, a main pump outlet line 74, branch lines 76, 78 extending through heat exchangers 30, 32, respectively, and inlet lines 58, 64. Wet glycol is exhausted from the glycol sump 62 to pump motor 19 through a line 80 and delivered to the still column 38 of reboiler means 34 through a line 82, glycol-glycol heat exchanger means 46, and a line 84. Wet glycol flows downwardly in the still column means 38 toward reboiler tank means 40 as indicated by dashed line 86. The water in the glycol is vaporized by heat obtained from gas burner means 36 through firetube means 42 which extends into the tank means 40. Vaporized water in the form of steam is removed from the upper end of still column means 38 through an outlet line 88. Hot dry glycol is collected in tank means 40, flows downwardly through a line 89 into the top of heat exchanger means 46 containing glycol heating coil means 83. Cooled dry glycol is transmitted from the bottom of the heat exchanger tank to the upper portion of dry glycol storage means 44 through a line 90. A gas reservoir means 91 is connected to dry gas line 72 by a regulator means 92 which maintains a supply of relatively low pressure (e.g., 15 psi) dry gas in reservoir means 91. Burner 36 is connected to reservoir 91 by a dry gas line 93 through a regulator means 94, which reduces the pressure of dry gas to approximately 10 psi. Gas reservoir 91 has a pressure relief valve 95 to control dry gas pressure therein. Pump regulator and secondary motor means 21 is operated by relatively low pressure (e.g., 60 to 80 psig) dry gas received through an operating line 96 connected to outlet line 72 through regulator means 97*a*, 97*b* and by relatively high pressure (e.g., 80 to 100 psig) dry gas received through a pilot line 97*c*. Dry gas in pump regulator 21 is exhausted to reservoir 91 or burner 36 through a line 98. An adjustable flow control valve means 99 in line 96 controls the rate of operation (i.e. speed) of the pump 19.

THE PUMP UNIT

In General

Figure 2A:
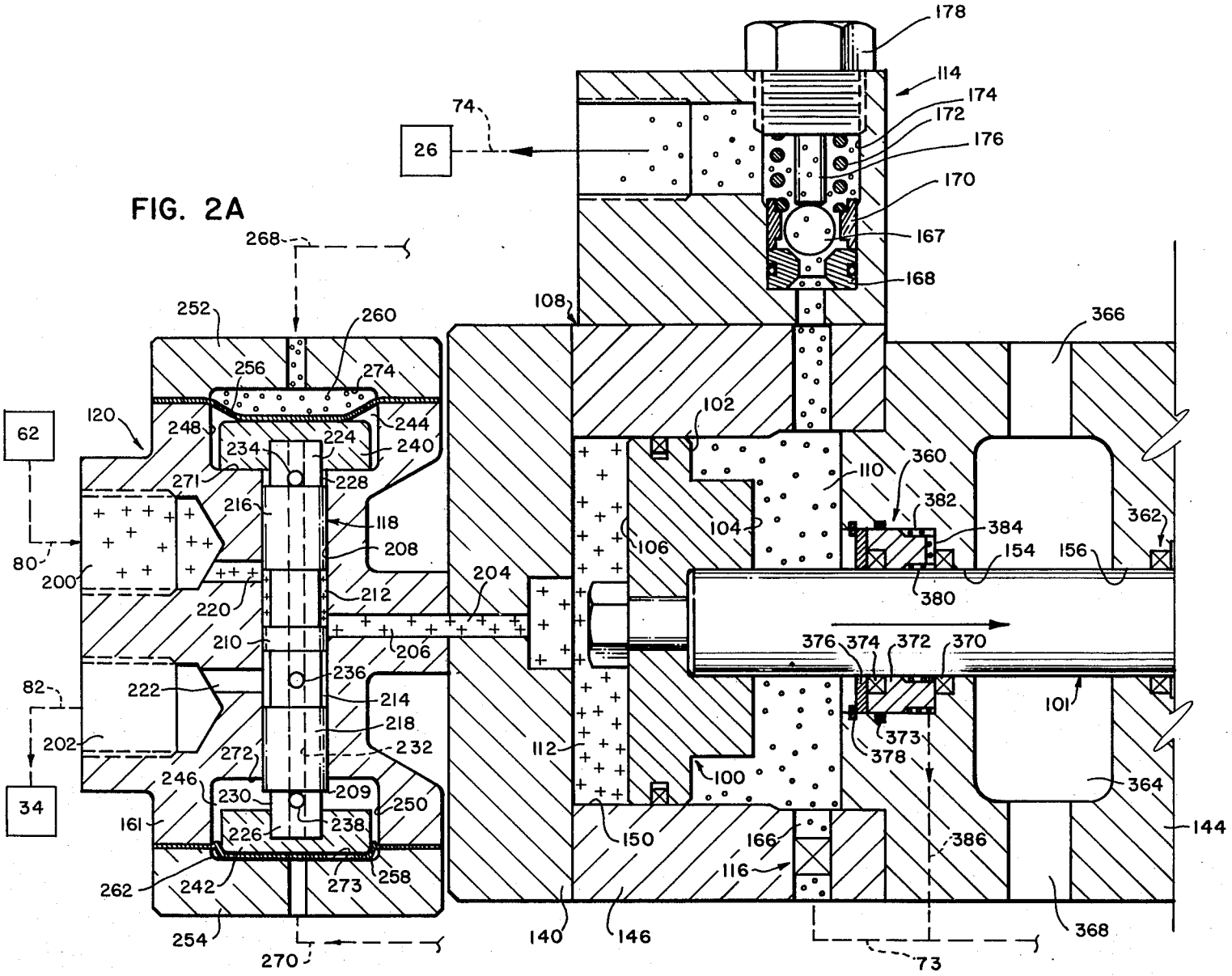
FIGS. 2A & 2B are a cross-sectional side elevational view of an illustrative embodiment of the invention with some of the fixed parts displaced for purposes of illustration and with reciprocating piston parts of a motor-pump section and a motor-regulating section located in a leftward position relative to associated cylinder parts at the beginning of a dry glycol pumping stroke.
Figure 2B:
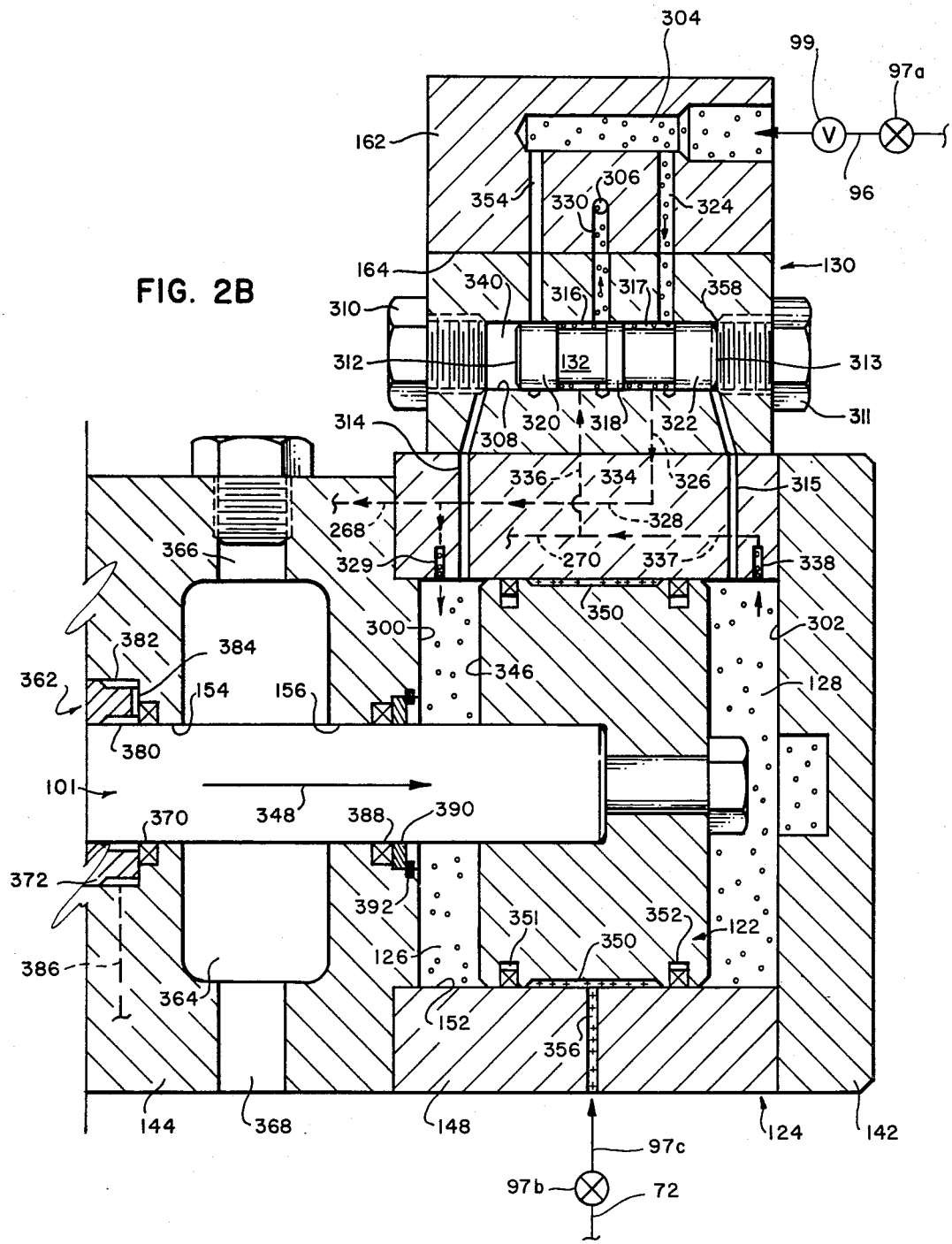
Figure 3A:
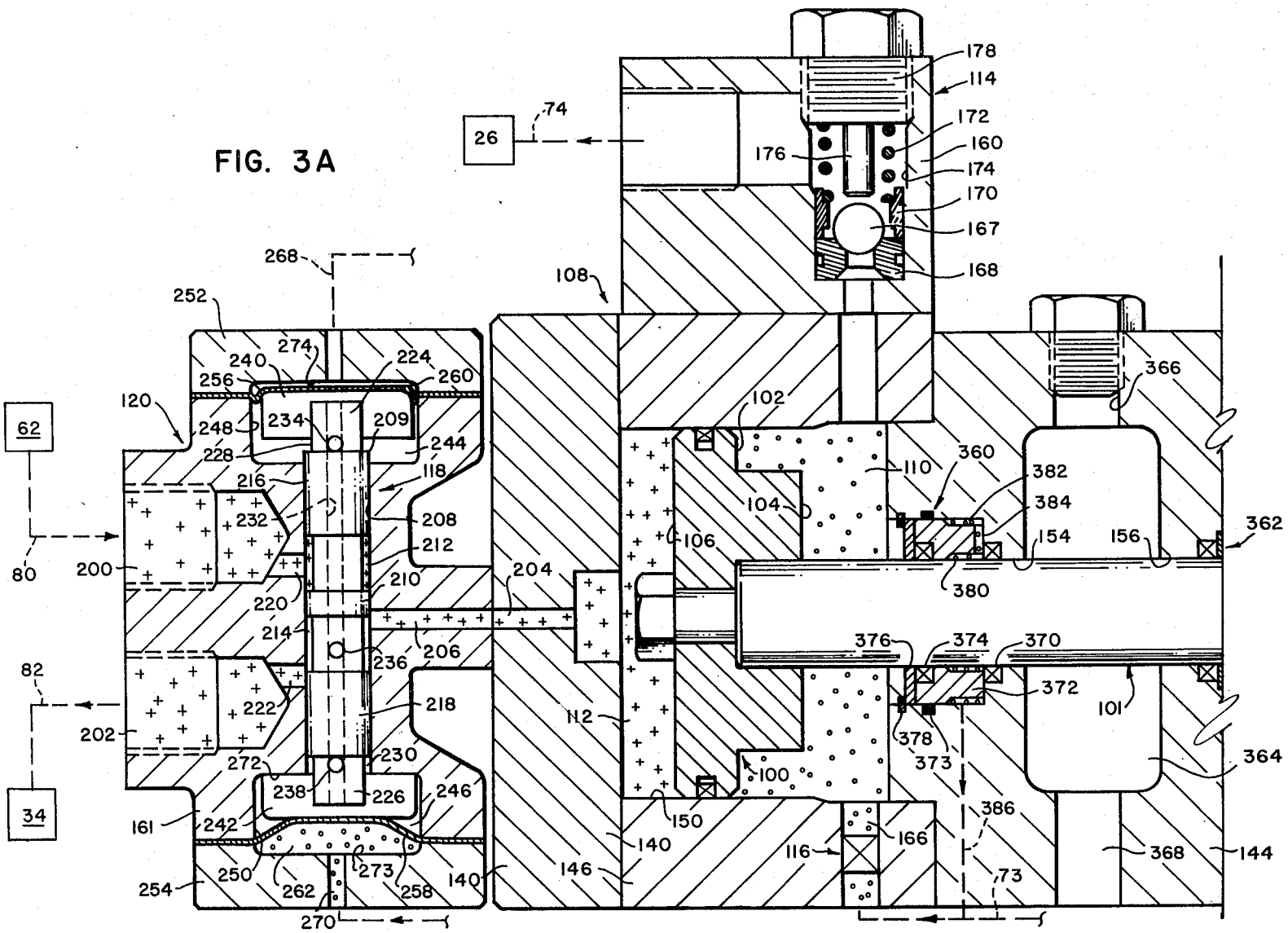
FIGS. 3A & 3B are a cross-sectional side elevational view of the apparatus of FIGS. 2A & 2B with piston parts located in a leftward shifted position at the end of a return stroke.

In general, as shown in FIGS. 2A & 3A, the motor and pump sections 19, 20 of the pump means unit 18 of the present invention comprise an integral one piece reciprocable piston means 100 mounted on one end of a reciprocal piston rod means 101 to provide fluid pump piston means surfaces 102, 104 and an oppositely facing drive motor piston means surface 106. A cylinder means 108 freely reciprocably slidably supports piston means 100. A variable volume pump chamber means 110 is provided on one side of piston means 100 and a variable volume motor chamber means 112 is provided on the opposite side. Fluid flow control means 114, 116, in the form of ball type check valve assemblies mounted on the periphery of cylinder means 108, control the flow of dry glycol fluid to and from pump chamber 110. A fluid flow control means, in the form of a reciprocable spool type valve member 118, slidably centrally mounted in a valve housing means 120 on one end of cylinder means 108, controls the flow of wet glycol fluid to and from motor chamber 112. The motor-regulator section 21 of the pump means unit 18, FIGS. 2B & 3B, comprises a piston means 122 connected to the other end of rod means 101 and freely reciprocably slidably mounted in a cylinder means 124 with variable volume fluid chambers 126, 128 on opposite sides thereof. A fluid flow control means 130, including reciprocable spool valve member 132, controls the flow of dry gas to and from chambers 126, 128.

The Pump Housing

The motor-pump-regulator sections 19, 20, 21 of the pump unit form an elongated multiple part generally cylindrical housing unit having opposite end plates 140, 142, and separated into combined motor-pump housing sections 19, 20 and a motor-regulator housing section 21 by a central cylinder seal plate member 144. The motor-pump housing section 19 & 20 and motor-regulator section 21 comprise axially spaced generally cylindrical members 146, 148 having coaxial cylindrical bores 150, 152 and located on opposite sides of and in abutting supporting coaxial sealed engagement with central cylindrical member 144 having coaxial cylindrical bores 154, 156 for receiving piston rod means 101. Flow control means 114, 116 are of identical construction. Each comprises a control valve block member 160 suitably mounted in fixed abutting sealed relationship on support surfaces on the periphery of cylindrical member 146. Flow control housing means 120 comprise a valve housing member 161 mounted in fixed coaxial abutting sealed relationship on end plate 140. Fluid control means 130 comprises a control valve block members 162, 164 mounted in fixed abutting sealed relationship with cylindrical member 148. The housing components are mounted in fixed abutting supporting sealed engagement by suitable bolt means (not shown) and suitable sealing means (not shown) are provided at fluid passage and chamber interfaces.

The Motor-Pump Section

Pump chamber 110, FIGS. 2A & 3A, is connected to dry glycol inlet line 73 through valve means 116 by an inlet port 166. When piston means 100 moves to the left, FIG. 3A, the volume of chamber 110 is increased and pressure is reduced whereby valve means 116 is opened and valve means 114 is closed to enable dry glycol to flow into chamber 110 from dry glycol storage line 73. When piston means 100 moves to the right, FIG. 2A, the volume of chamber 110 is decreased to increase the pressure of dry glycol in chamber 110 which forces valve means 116 to the closed position while causing valve means 114 to be moved to the open position to enable flow of dry glycol thereby to absorber line 74. Each of the valve means 114, 116 comprises a ball 167, a removable seat insert 168, a removable passage insert 170 and an insert retaining spring 172 mounted in a bore 174 in valve block 160. A pin member 176 on a threaded plug 178 limits movement of the ball valve.

The wet glycol inlet line 80 is connected to an inlet chamber 200 in housing member 161 and wet glycol outlet line 82 is connected to an outlet chamber 202 in member 161 to enable wet glycol to be alternately received in and discharged from motor chamber 112 through intake and exhaust passage means in valve spool means 118 as hereinafter described. An axial passage 204 in end plate 140 and an aligned co-axial passage 206 in member 161 connect chamber 112 to a central spool bore 208 in member 161 which slidably reciprocably supports a valve spool member 209. Flow of wet glycol from chamber 200 into central spool bore 208 is controlled by a central annular valve portion 210 on spool valve member 209. Valve portion 210 has an axial width greater than the diameter of passage 206 so as to close the passage in a central position of the valve spool member. Portions of the valve spool member on adjacent opposite sides of valve portion 210 are reduced in diameter to provide elongated axially extending equal length annular passages 212, 214 terminated by annular valve portions 216, 218. Passages 212, 214 alternately connect passage 206 to either of wet glycol inlet passage 220 or wet glycol outlet passage 222 which are connected to chambers 200, 202, respectively. Opposite end portions 224, 226 of valve spool 118 are of reduced diameter to provide elongated annular passages 228, 230. A central bore 232 in spool member 118 is connected to passages 214, 228 & 230 by radially extending passages 234, 236, 238. Piston members 240, 242 are fixedly mounted on end portions 224, 226 within chambers 244, 246 defined by enlarged counterbores 248, 250 in member 161 and covered by cap members 252, 254. Flexible resilient diaphragm members 256, 258 extend across chambers 244, 246 to provide sealed outer chamber portions 260, 262. Each outer chamber portion 260, 262 is connectable to a dry gas source through control valve means 132 by suitable passages 268, 270 to provide control means whereby the spool member 209 is positively shifted between wet glycol intake and exhaust positions as hereinafter described. In the position shown in FIG. 2A, the valve spool 209 is located in the intake position whereat high pressure wet glycol flows from port 200 through passages 220, 212, 206, 204 to motor chamber 112. Spool 118 is held in the intake position by gas pressure in chamber portion 260 acting against piston 240 through diaphragm 256. As piston 240 moves toward the retracted seated position on surface 271, glycol in chamber portion 244 is displaced through passages 236, 232, 234, 238, 222. And piston 242 and diaphragm 258 move to the extended position against cap surface 273 to exhaust gas from chamber portion 262 through gas passage 270.

After piston 100 is moved to the right during the pumping stroke, gas in chamber portion 260 is exhausted while gas under pressure is delivered to chamber portion 262 through passage 270. Gas pressure acts on piston 242 through diaphragm 258 to force piston 242 to move inwardly toward and then seat on shoulder 272 and move the spool 209 to the exhaust position FIG. 3A. The initial movement of piston 242 forces glycol out of chamber portion 246 through passage 238 to passage 232. Some of the glycol is forced into passage 228 and then into chamber portion 244 to exert force on piston 240 and diaphragm 256 to assist exhaust of gas in chamber portion 260 and movement thereof to the glycol exhaust position against cap surface 274. It is to be understood that the valve spool 209 is moved from the glycol exhaust position to the glycol intake position in a similar manner when chamber portion 260 is subsequently connected to gas under pressure while chamber portion 262 is connected to exhaust. In the presently preferred embodiment, passages 268, 270 comprise drilled holes extending through the unit components.

The Pump Regulator & Secondary Motor Section

Figure 3B:
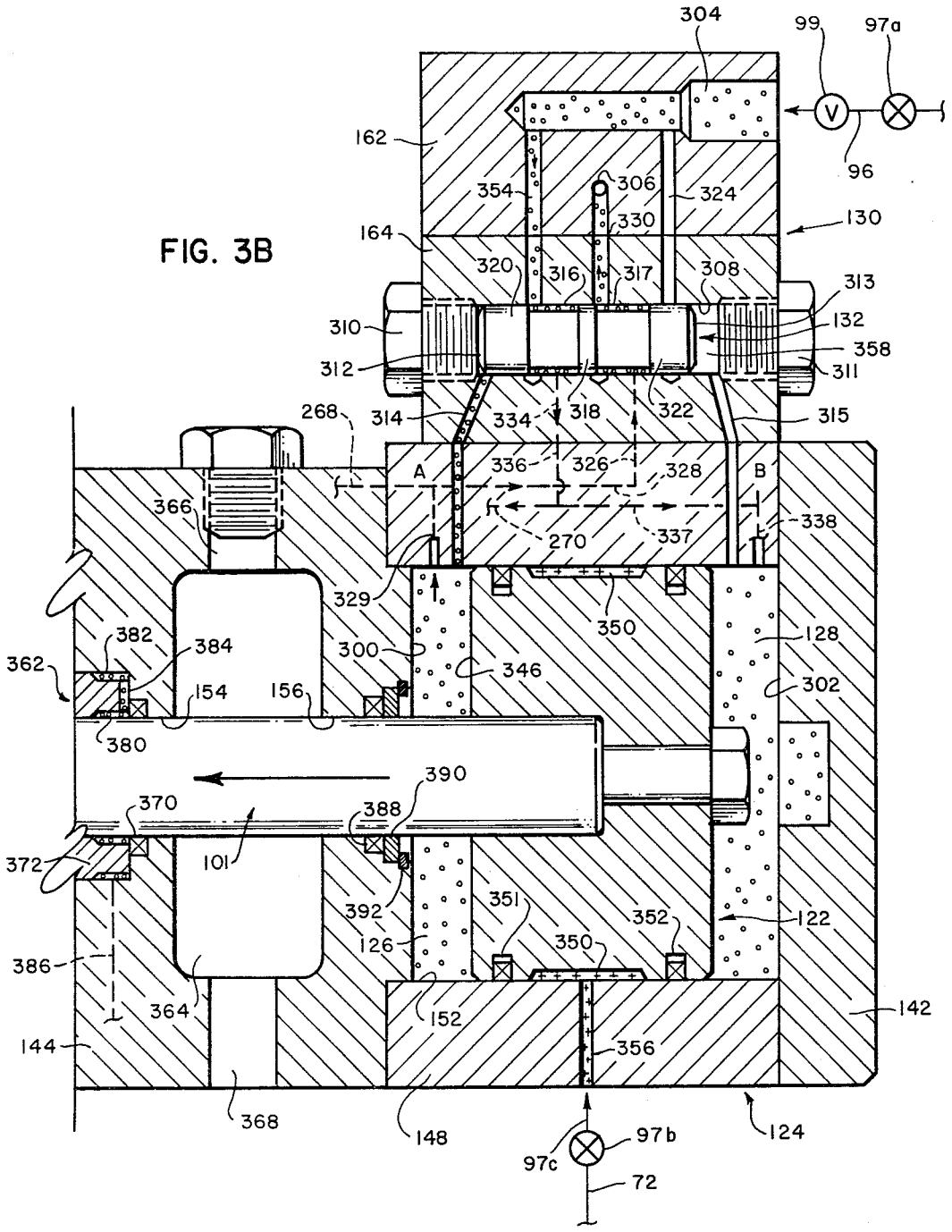

The position of motor control valve spool member 209 relative to motor-pump piston means 100 is controlled by the position of regulator piston means 122, FIGS. 2B & 3B, which is reciprocably movable between end walls 300, 302 of chambers 126, 128 by pressurized dry gas alternately received and exhausted from dry gas inlet and outlet ports 304, 306. The flow of dry gas to and from chambers 126, 128 is controlled by spool valve means 132 which is reciprocably movable in a bore 308 in valve block 164, closed by plug members 310, 311, between oppositely displaced control positions whereat the end surfaces 312, 313 abut the adjacent ends of the plugs. Valve means 132 is positively alternately located in one or the other of the control positions by gas pressure control passage means 314, 315 operatively associated with piston 122. Spool valve means 132 comprises a pair of elongated reduced diameter fluid passage portions 316, 317 located between a central annular valve portion 318 and end valve portions 320, 322. When spool valve 132 is located in a rightwardmost position as shown in FIG. 2B, gas inlet 304 is connected to chamber 126 through passage 324 in valve blocks 162, 164, spool passage 317, passage 326 in valve block 164, and passages 328, 329 in cylinder member 148. Exhaust port 306 is connected to chamber 128 through passage 330 in valve blocks 162, 164, spool passage 316, passage 334 in valve block 164, and passages 336, 337, 338 in cylinder member 148. Thus, the pressurized dry gas exerts a force on piston surface 346 in the direction of arrow 348 and causes movement of the piston 122 in the direction of the arrow 348 while the motor-pump piston means 100 is being driven in the same direction by force being exerted on motor piston surface portion 106, FIG. 2A, by wet glycol in motor chamber 112. At the same time, passage 314 connects chamber 126 to spool valve chamber 340 whereby gas flows to chamber 340 to exert pressure on spool end surface 312 and maintain opposite spool end surface 313 in engagement with plug 311. In order to shift spool valve 132, a sealed groove 350 (FIGS. 2B, 3B, & 4) is provided on the periphery of piston 122 between suitable square cut sealing ring devices 351, 352. Groove 350 is continuously connected by a passage 356 in member 148 to gas line **97*c* and pressure regulator means 97*b*. Regulator means 97*b* maintains a relatively high gas pressure (e.g., 80 to 100 psig) compared to the pressure of the gas at inlet port 304 (e.g., 60 to 80 psig) with approximately a 20 psig differential being maintained therebetween. When piston 122 reaches the end of the glycol pumping stroke, FIG. 4, groove 350 is connected to passage 315 and relatively high pressure gas flows to spool valve chamber 358 to exert a greater force on spool end surface 313 than the force exerted on spool end surface 312 by gas from inlet port 304 and chamber 126 through passage 314. Thus, spool valve 132 is shifted to the leftward position of FIG. 3B. As the spool valve 132 is shifted to the left, spool passage 317 becomes aligned with exhaust passages 330 & 306 while spool passage 316 becomes aligned with intake passages 304, 354, 334, 336, 337, 338 to deliver gas to chamber 128 and drive piston 122 toward the left. At the same time, wet glycol spool control chambers 260, 262 are connected to high pressure gas intake and exhaust ports 304, 306 through passages 268, 270 in response to movement of valve spool 132 caused by flow of gas through passage 270 to chamber 258**.

Piston rod sealing means 360, 362 are provided in center plate 144 to prevent leakage of dry glycol from pump chamber 110 and gas from gas chamber 126 along piston rod 101. A vent chamber means 364 is provided to receive any glycol or gas which leaks past sealing means 360, 362. Plugged passages 366, 368 enable removal of glycol or gas from vent chamber means 364. Seal means 360 comprises a lip type sealing ring member 370, a sleeve member 372, a lip type sealing ring member 374, a washer member 376, and a retaining ring member 378. Sleeve member 372 has inner and outer peripheral grooves 380, 382 connected by a radial passage 384. Groove 380 is connected to a passage 386 which connects to dry glycol line 73 downstream of check valve means 116 so as to create a suction effect causing dry leakage glycol received in groove 380 to be withdrawn therefrom through passage 384, groove 382 and passage 386 to line 73. Thus positive drainage means are provided to remove dry glycol from sealing means 360. Sealing means 362 comprises a lip type sealing ring member 388, a washer member 390 and a retainer ring member 392.

Figure 5:
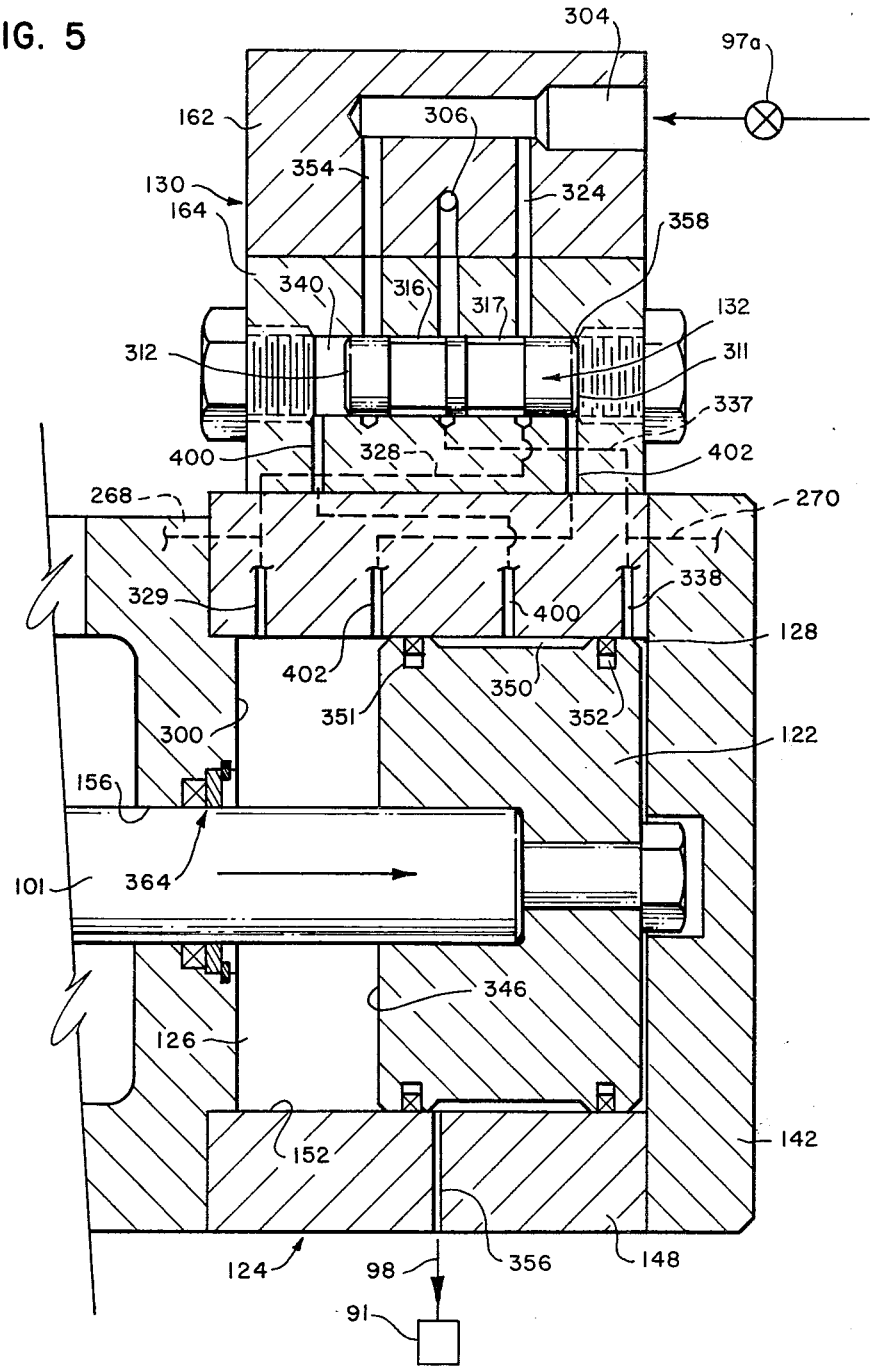
FIG. 5 is a cross-sectional side elevational view of the motor-regulating section of the apparatus of FIG. 1 illustrating a modification of the control system.

Referring to FIG. 5, an alternative shuttle control means embodiment of the invention is shown to comprise a pair of passages 400, 402 extending between opposite ends of the spool valve 132 and gas chambers 126, 128. Passages 400, 402 are axially spaced so as to be alternately connected to high pressure gas in chambers 126, 128 at the end of each stroke of piston 122 and to groove 350 during an intermediate portion of each stroke. Groove 350 is connected to a atmosphere or to low pressure line, such as line 98, or receptacle such as gas reservoir 91 through passage 356. Thus, high pressure gas is alternately exhausted from one of chambers 340, 358 through one of the passages 400, 402 to groove 350 and through passage 356 and high pressure gas will be alternately delivered to the opposite one of chambers 340, 358 to cause the spool valve to be shifted.

OPERATION

FIGS. *3a & b* show the pistons 100, 122 moving to the left. The gas shuttle valve 132 is shown shifted to the left and high pressure gas is entering the right hand gas cylinder chamber 128 while the left hand gas cylinder chamber 126 is connected to low pressure. The high pressure gas is also imposed on the diaphragm 258 and to move spool valve 118 into the upward position shown in FIG. *3a*. This connects motor chamber 112 with the wet low pressure glycol output line 82 to cause the wet glycol to be expelled from the motor chamber. Dry glycol simultaneously is drawn through the dry glycol suction check valve 116 into the dry glycol pump chamber 110. The action shown in FIGS. *3a & 3b* is the low pressure cycle of the pump and all energy for this cycle is derived from the gas motor end.

FIGS. *2a & 2b* show the high pressure cycle of the pump. The gas and glycol pistons 100, 122 are now moving to the right. The gas shuttle valve 132 is shifted to the right directing high pressure gas on the left end 346 of the gas piston 122 while the right end gas chamber 128 is connected to the low pressure gas outlet 306. High pressure gas acting on the upper valve diaphragm 256 has now shifted the glycol spool valve 118 into the downward position shown in FIG. *2a*, and high pressure wet glycol line 200 is connected to the wet glycol motor chamber 112. The force of the gas differential pressure acting on the gas piston 122 plus the force of the wet high pressure glycol acting on the motor face 106 of the glycol piston 100 forces the pistons and piston rod to the right causing dry glycol to be forced out through the pump discharge check valve 114 at high pressure.

Figure 4:
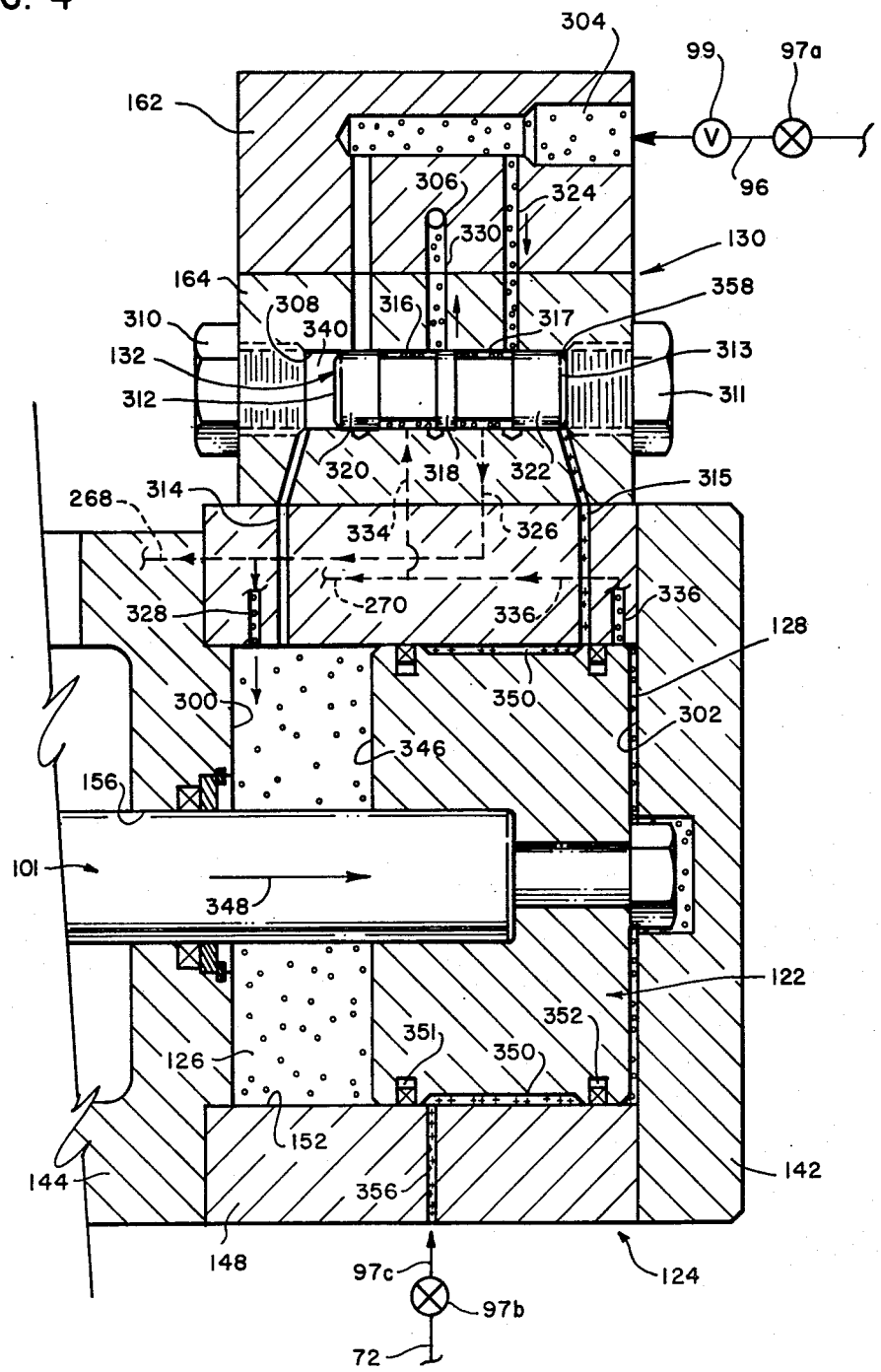
FIG. 4 is a cross-sectional side elevational view of the motor-regulating section of the apparatus of FIG. 1 with the piston parts located in a rightward shifted position at the end of a pumping stroke.

When the gas piston 122 reaches the right end of its stroke, FIG. 4, the square-out piston seal, 352, just clears the pilot shift passage 315, allowing pilot pressure in groove 350 to communicate with the right end chamber 358 of the gas shuttle valve 132. Since pilot gas pressure is greater than the pressure of gas imposed on the left end 312 of the gas shuttle valve, the valve shifts to the left. At the opposite end of the gas piston stroke, a similar action occurs shifting the gas shuttle valve back to the right.

The present invention has been heretofore described in connection with a presently particularly preferred embodiment. However, various modifications may be apparent to those skilled in the art from this description. For example, it is apparent that the areas described herein as motor or drive areas may be designed as pumping areas, while those areas described as pumping areas may be designed as motor or drive areas. These and other modifications are intended to be within the scope of the appended claims except insofar as precluded by the prior art.

What is claimed is:

1. A fluid pumping system for use with a natural gas dehydrating system or the like having an absorber apparatus for removing water from wet natural gas to produce dry natural gas by use of a dessicant agent such as glycol, a glycol reboiler means for producing a source of dry glycol from wet glycol received from the absorber apparatus by heat obtained from burning of the natural gas, the system comprising:

a single stage reciprocable fluid pump means operatively connected between dry glycol source and the absorber means for pumping dry glycol from the dry glycol source to the absorber means said fluid pump means comprising a piston means and a cylinder means defining a second variable volume fluid chamber means for receiving dry glycol during an intake stroke in one direction and for discharging dry glycol during a discharge stroke in the opposite direction;

a single stage reciprocable fluid operable primary motor means operatively connected to said pump means for actuating said pump means during said discharge stroke and having fluid inlet passage means for receiving wet glycol from said absorber during said intake stroke and fluid outlet passage means for delivering wet glycol to said glycol reboiler means during said discharge stroke whereby energy derived from the wet glycol provides the primary motivating force for driving said motor means and said pump means during the discharge stroke; and a speed control means being operable by the dry natural gas and operatively associated with said pump means and said motor means for automatically regulating the speed thereof; and said speed control means being a fluid operable device operatively connected to and operable by the pressure of the natural gas which is constructed and arranged to provide a secondary motor means for actuating said primary motor means and said fluid pump means during the exhaust stroke.

2. The invention as defined in claim 1 and wherein said piston means and said cylinder means further defining a second variable volume chamber means for receiving wet glycol during the discharge stroke of said pump means and discharging wet glycol during the intake stroke of said pump means.

3. The invention as defined in claim 1 wherein said speed control means comprising:

a cylinder means having variable volume fluid chambers at opposite ends thereof for receiving and exhausing natural gas therewithin;

a piston means having opposite piston head surfaces thereon and being freely reciprocable slideably mounted in said cylinder means for reciprocable movement therewithin to alternately cause intake and exhaust of natural gas to and from said variable volume fluid chambers; and a gas flow control valve means for controlling intake and exhaust of natural gas to and from said variable volume fluid chambers.

4. The invention as defined in claim 3 and wherein said gas flow control valve means comprising:

a spool valve means reciprocably slideably mounted for movement between first and second axially displaced positions; and spool valve control means operatively connecting said spool valve means to said piston means for causing positive actuation of said valve control means.

5. The invention as defined in claim 1 and further comprising:

a control valve means for controlling flow of wet glycol to said second chamber means during said discharge stroke and from said second chamber means during said intake stroke;

6. The invention as defined in claim 5 and wherein said control valve means comprising:

a spool valve device having opposite end surfaces alternately connectable to the dry natural gas at the end of each stroke.

7. A pump system for pumping dry glycol from a dry glycol source to an absorber means by the use of wet glycol from a wet glycol source, the pump system being controlled by natural gas and comprising:

a glycol pump piston means reciprocably mounted in a glycol cylinder means to provide a wet glycol variable volume chamber means on one side of said piston means for receiving wet glycol from the wet glycol source to drive the piston means in one direction during a dry glycol pumping stroke and for exhausting wet glycol from said wet glycol variable volume chamber means to a wet glycol reboiler means during movement of said piston means in the opposite direction during a return stroke, and to provide a dry glycol variable volume chamber means on the other side of said piston means for receiving dry glycol from the dry glycol source during movement of said piston means in the opposite direction and for pumping dry glycol from said dry glycol chamber means to the absorber means during movement of said piston means in the one direction;

dry glycol flow control valve means operatively associated with said dry glycol chamber means for controlling flow of dry glycol into said dry glycol chamber means during the return stroke of said glycol piston means and flow of dry glycol from said dry glycol chamber means during the pumping stroke;

a gas operable piston means reciprocably mounted in a gas cylinder means to provide variable volume gas chamber means on opposite sides of said gas piston means for receiving gas at a first pressure from a gas source to drive said gas operable piston means in opposite directions;

a piston rod means for connecting said glycol pump piston means to said gas operated piston means and extending outwardly beyond said dry glycol chamber means and into a next adjacent one of said gas chamber means;

a gas operated wet glycol flow control shuttle valve means operably associated with said wet glycol variable volume chamber means for controlling intake and exhaust of wet glycol relative to said wet glycol variable chamber means and being movable between a wet glycol intake position whereat said wet glycol source is connected to said wet glycol chamber means to drive said glycol pump means in said first direction and a wet glycol exhaust position whereat said wet glycol chamber means is connected to said absorber means during movement of said glycol pump means in said opposite direction;

a gas operated gas flow control shuttle valve means being movable between alternate opposite intake and exhaust positions relative to said gas chamber means and operably associated with said gas piston means for controlling the flow of operating gas at the first pressure from said gas source to said variable volume gas chamber means and for controlling the exhaust of operating gas from said variable volume gas chamber means whereby said gas piston means is driven in the same direction as said glycol piston means during the pumping stroke and assists the movement of said glycol piston means in that one direction and whereby said gas piston means is driven in the opposite direction during the return stroke of said glycol piston means and provides the primary motivating force causing movement of said glycol piston means in the opposite direction; and gas passage means for connecting said gas flow control shuttle valve means to said glycol flow control shuttle valve means whereby said glycol flow control shuttle valve means is moved between the glycol intake position and the glycol exhaust position at the same time as said gas flow control shuttle valve means is moved between said alternate opposite intake and exhaust positions.

8. The invention as defined in claim 7 and further comprising:

gas flow passage means on said gas cylinder means and being operably associated with said gas flow control shuttle valve means for changing gas pressure acting on opposite ends of said gas flow control shuttle valve means at the end of each stroke of said gas piston means whereby said gas flow control shuttle vavle means and said glycol flow shuttle valve means are synchronously shifted in response to the location of said gas piston means.

9. The invention as defined in claim 8 and wherein:

said gas flow passage means being connected through said gas piston means to a source of gas at a higher pressure than the source of gas connected to said gas chamber means through said gas flow control shuttle valve means.

10. The invention as defined in claim 8 and wherein:

said gas flow passage means being connected through said gas piston means to a gas outlet means at a lower pressure than the source of gas connected to said gas chamber means through said gas flow control shuttle valve means.

11. The invention as defined in claim 7 and further comprising:

dry glycol and gas sealing means mounted circumjacent said piston rod means for controlling flow of dry glycol relative thereto from said dry glycol chamber means and for controlling flow of gas relative thereto from said next adjacent gas chamber means; and dry glycol passage means connected between said dry glycol sealing means and said dry glycol flow control valve means for causing flow of dry glycol from said dry glycol sealing means to said dry glycol chamber means through said dry glycol flow control valve means.

12. The invention as defined in claim 11 and further comprising:

a seal plate means mounted between said dry glycol chamber means and said next adjacent gas chamber means for reciprocally supporting said piston rod means and said dry glycol and gas sealing means and having a drainage chamber therebetween.

13. A method of pumping dry glycol from a dry glycol source to a dehydration device of a natural gas dehydrating system comprising the steps of:

utilizing the energy of wet glycol from the dehydrater device to operate a pump means for pumping the dry glycol from the dry glycol source to the dehydrater device;

utilizing dry gas from the dehydrater device to control the rate of reciprocation of the pump means; and utilizing dry gas from the dehydrator device to control the intake and exhaust of wet glycol to and from the pump means.

14. The method as defined in claim 13 and further comprising:

regulating the rate of reciprocation of the dry glycol pump means and the wet glycol motor means by controlling the rate of flow of dry gas through a gas operated pump regulator means operatively associated with said motor means.

15. The method as defined in claim 14 and further comprising:

utilizing the energy of the dry gas to assist the movement of said pump means during the pumping stroke and to cause return of the pump means.

* * * * *